US011920845B2

(12) United States Patent
Schiller et al.

(10) Patent No.: US 11,920,845 B2
(45) Date of Patent: Mar. 5, 2024

(54) FLOW RATE CONTROL METHOD FOR AN ICE MAKING ASSEMBLY

(71) Applicants: Jin Wu, Shanghai (CN); Haier US Appliance Solutions, Inc., Wilmington, DE (US)

(72) Inventors: Andrew Schiller, Louisville, KY (US); Adam Pusateri, Canton, OH (US); Justin Tyler Brown, Louisville, KY (US); Brent Alden Junge, Evansville, IN (US); Jin Wu, Shanghai (CN); Bo Yan, Shanghai (CN); Yayu Song, Shanghai (CN); Michael Zhou, Shanghai (CN); Roy Teng, Shanghai (CN); Eddy Zhou, Shanghai (CN); Jason Jiang, Shanghai (CN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 96 days.

(21) Appl. No.: 17/428,328

(22) PCT Filed: Oct. 15, 2020

(86) PCT No.: PCT/CN2020/121174
§ 371 (c)(1),
(2) Date: Aug. 4, 2021

(87) PCT Pub. No.: WO2022/077347
PCT Pub. Date: Apr. 21, 2022

(65) Prior Publication Data

US 2022/0299248 A1 Sep. 22, 2022

(51) Int. Cl.
*F25C 1/045* (2018.01)
*F25C 1/12* (2006.01)

(52) U.S. Cl.
CPC ..... *F25C 1/045* (2013.01); *F25C 1/12* (2013.01); *F25C 2400/14* (2013.01)

(58) Field of Classification Search
CPC ..... F25C 2400/14; F25C 5/02–04; F25C 5/08–10; F25C 1/045; F25C 1/12; B05B 7/0823
See application file for complete search history.

(56) References Cited

U.S. PATENT DOCUMENTS 3,964,270 A * 6/1976 Dwyer ..... F25C 1/12 62/158
4,006,605 A 2/1977 Dickson et al.
(Continued)

FOREIGN PATENT DOCUMENTS

CN 1621767 A 6/2005
CN 206094689 U 4/2017
(Continued)

OTHER PUBLICATIONS

Machine English Language translation of DE-1020060110068 to Held. Entire document. Translated Jun. 2023 (Year: 2007).*
(Continued)

*Primary Examiner* — Cassey D Bauer
(74) *Attorney, Agent, or Firm* — Dority & Manning, P.A.

(57) ABSTRACT

An ice making assembly includes an ice mold and a pump assembly for urging an ice-building spray into the ice mold to form an ice billet. A controller operates the pump assembly to provide the ice-building spray at a first flow rate until the ice billet reaches a predetermined thickness and then operates the pump assembly to provide the ice-building spray at a second flow rate that is less than the first flow rate.

19 Claims, 9 Drawing Sheets

(56) References Cited

U.S. PATENT DOCUMENTS

| | | | | | |
|---|---|---|---|---|---|
| 4,238,930 | A | | 12/1980 | Hogan | |
| 4,359,874 | A | | 11/1982 | McCarty | |
| 4,966,015 | A | | 10/1990 | Wessa | |
| 4,970,877 | A | | 11/1990 | Dimijian | |
| 4,990,169 | A | * | 2/1991 | Broadbent | F25C 1/125 426/66 |
| 5,117,645 | A | | 6/1992 | Bryant | |
| 5,167,132 | A | | 12/1992 | Meier | |
| 5,224,358 | A | | 7/1993 | Yamanaka et al. | |
| 6,357,720 | B1 | | 3/2002 | Shapiro et al. | |
| 6,453,696 | B1 | | 9/2002 | Hayakawa Shinsaku | |
| 6,502,416 | B2 | | 1/2003 | Kawasumi et al. | |
| 7,062,936 | B2 | | 6/2006 | Rand et al. | |
| 2007/0079627 | A1 | | 4/2007 | Broadbent | |
| 2017/0370628 | A1 | * | 12/2017 | Knatt | F25C 1/25 |
| 2018/0017304 | A1 | * | 1/2018 | Knatt | F25C 1/045 |
| 2020/0041186 | A1 | | 2/2020 | Tyler | |

FOREIGN PATENT DOCUMENTS

| | | | | | |
|---|---|---|---|---|---|
| CN | 109642764 | A | | 4/2019 | |
| DE | 102006010068 | B3 | * | 3/2007 | F25C 1/12 |
| JP | 2003262442 | A | | 9/2003 | |
| JP | 2004132645 | A | | 4/2004 | |
| JP | 2004225924 | A | | 8/2004 | |
| JP | 2005061824 | A | * | 3/2005 | F25C 1/04 |
| JP | 2015190707 | A | | 11/2015 | |
| JP | 6089974 | B2 | | 3/2017 | |
| JP | 2017141985 | A | | 8/2017 | |
| KR | 200460218 | Y1 | | 5/2012 | |
| KR | 101556705 | B1 | | 10/2015 | |
| MY | 141042 | A | | 2/2010 | |
| RU | 2586919 | C2 | | 6/2016 | |
| WO | WO2018041519 | A1 | | 3/2018 | |

OTHER PUBLICATIONS

Machine English Language translation of JP2005061824 to Son. Entire document. Translated Jun. 2023 (Year: 2005).*

* cited by examiner

FLOW RATE CONTROL METHOD FOR AN ICE MAKING ASSEMBLY

CROSS-REFERENCE TO RELATED APPLICATIONS

The present application is the National Stage Entry of and claims the benefit of priority under 35 U.S.C. § 371 to PCT Application Serial No. PCT/CN2020/121174 filed Oct. 15, 2020 and entitled FLOW RATE CONTROL METHOD FOR AN ICE MAKING ASSEMBLY, which is hereby incorporated by reference in its entirety.

FIELD OF THE INVENTION

The present subject matter relates generally to ice making appliances, and more particularly to methods of regulating a pump assembly for an ice making appliance for producing large, clear pieces of ice.

BACKGROUND OF THE INVENTION

In domestic and commercial applications, ice is often formed as solid cubes, such as crescent cubes or generally rectangular blocks. Specifically, certain ice makers include a freezing mold that defines a plurality of cavities that can be filled with liquid water that freezes within the plurality of cavities to form solid ice cubes. Typical solid cubes or blocks may be relatively small in order to accommodate a large number of uses, such as temporary cold storage and rapid cooling of liquids in a wide range of sizes.

Notably, ice formed using conventional ice making appliances often suffers from impurities and gases that are trapped within ice cubes during formation. These impurities and gases may impart undesirable flavors into a beverage being cooled (i.e., a beverage in which the ice cube is placed) as the ice cube melts. In addition, these impurities and gases may cause an ice cube to melt unevenly or faster (e.g., by increasing the exposed surface area of the ice cube). In recent years, ice making appliances have been developed for forming relatively large ice billets in a manner that avoids trapping impurities and gases within the billet. In addition to forming ice that is more evenly-distributed or slower melting, these clear ice cubes (e.g., free of any visible impurities or dull finish) may provide a unique or upscale impression for the user.

Certain ice making appliances for forming large, clear ice billets utilize an inverted or upside-down mold and a spray nozzle that sprays water upwards into the mold cavity. In this manner, impurities fall back into a water basin while pure water slowly forms ice within the mold. In this regard, water in the cavities begins to freeze and solidify first from the sides and top surfaces, and slowly fills the remaining volume of the mold cavity. Notably, however, the spray of water has a tendency to bore a hole within the ice billet or dislodge portions of the ice within the mold, particularly as the ice build-up forms closer to the spray nozzle.

Accordingly, further improvements in the field of ice making would be desirable. In particular, it may be desirable to provide an appliance or methods for rapidly and reliably producing substantially clear ice.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an ice making assembly is provided including an ice mold defining a mold cavity, a pump assembly for urging an ice-building spray into the ice mold, and a controller in operative communication with the pump assembly. The controller is configured to operate the pump assembly to provide the ice-building spray at a first flow rate to form an ice billet within the ice mold, determine that the ice billet formed within the ice mold has exceeded a predetermined thickness, and operate the pump assembly to provide the ice-building spray at a second flow rate in response to determining that the ice billet has exceeded the predetermined thickness, wherein the second flow rate is different than the first flow rate.

In another exemplary aspect of the present disclosure, a method of forming an ice billet using an ice making assembly is provided. The ice making assembly includes an ice mold and a pump assembly for urging an ice-building spray into the ice mold. The method includes operating the pump assembly to provide the ice-building spray at a first flow rate to form an ice billet within the ice mold, determining that the ice billet formed within the ice mold has exceeded a predetermined thickness, and operating the pump assembly to provide the ice-building spray at a second flow rate in response to determining that the ice billet has exceeded the predetermined thickness, wherein the second flow rate is different than the first flow rate.

According to another exemplary aspect of the present disclosure, an ice making assembly is provided, including an ice mold defining a mold cavity, a pump assembly for urging an ice-building spray into the ice mold, a sealed refrigeration system comprising a condenser and an evaporator in serial flow communication with each other, the evaporator being in thermal communication with the ice mold, and a controller in operative communication with the pump assembly and the sealed refrigeration system. The controller is configured to cool the ice mold using the sealed refrigeration system, operate the pump assembly to provide the ice-building spray at a first flow rate to form an ice billet within the ice mold, determine that the formation of the ice billet is complete, operate the sealed system to warm the ice mold, and operate the pump assembly to provide the ice-building spray at a second flow rate to remove at least a portion of the ice billet These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
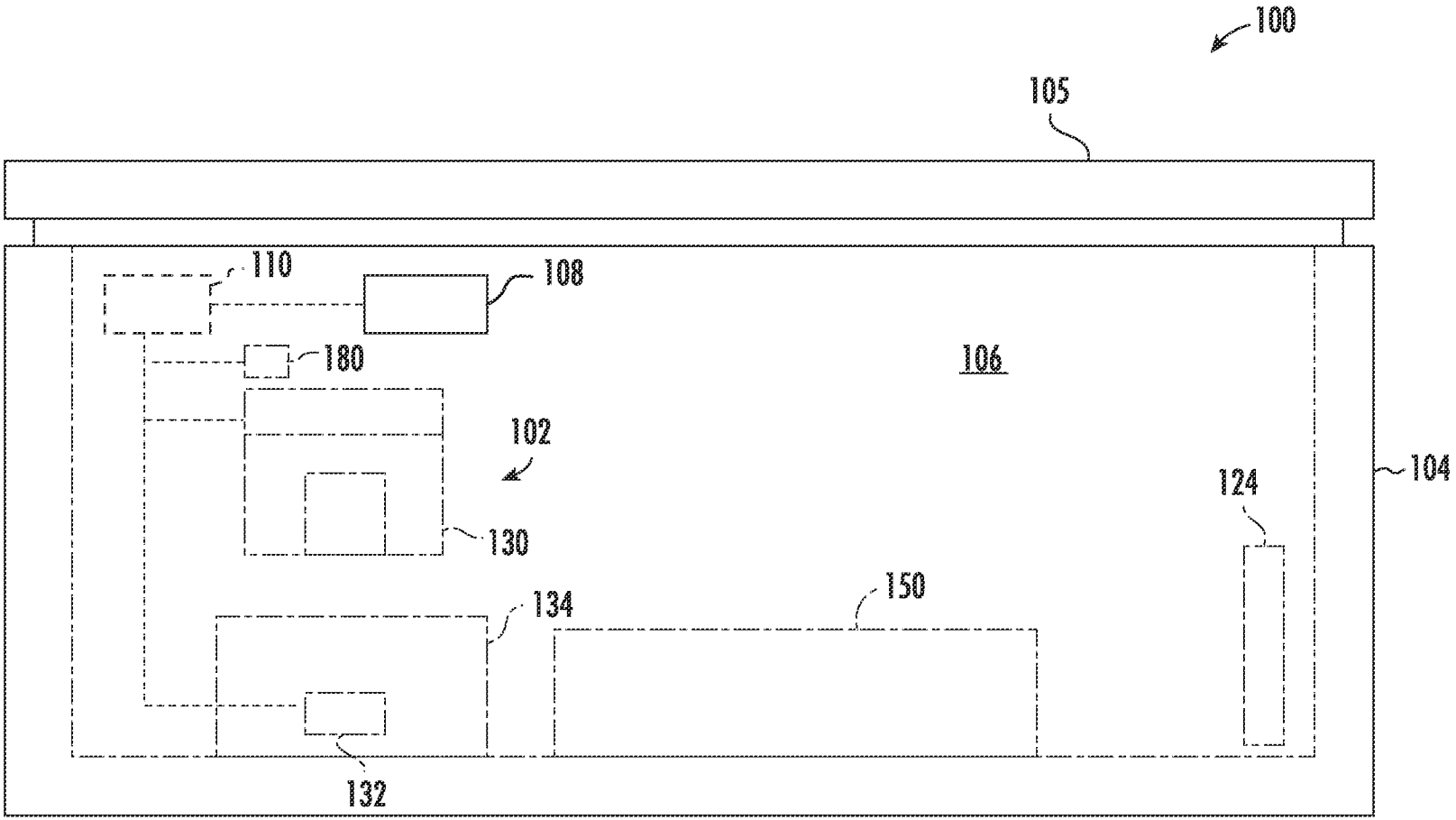
FIG. 1 provides a side plan view of an ice making appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
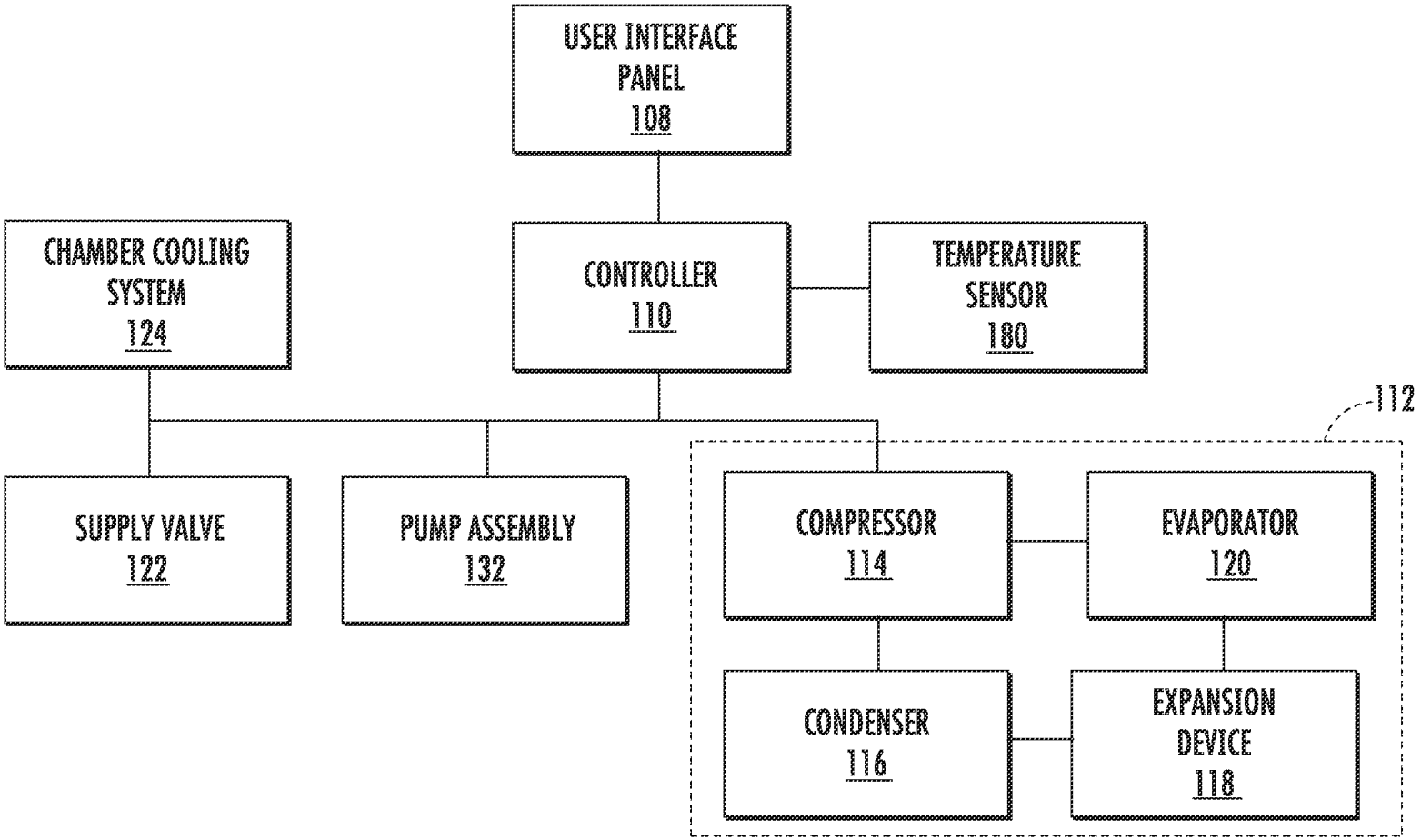
FIG. 2 provides a schematic view of an ice making assembly according to exemplary embodiments of the present disclosure.
Figure 3:
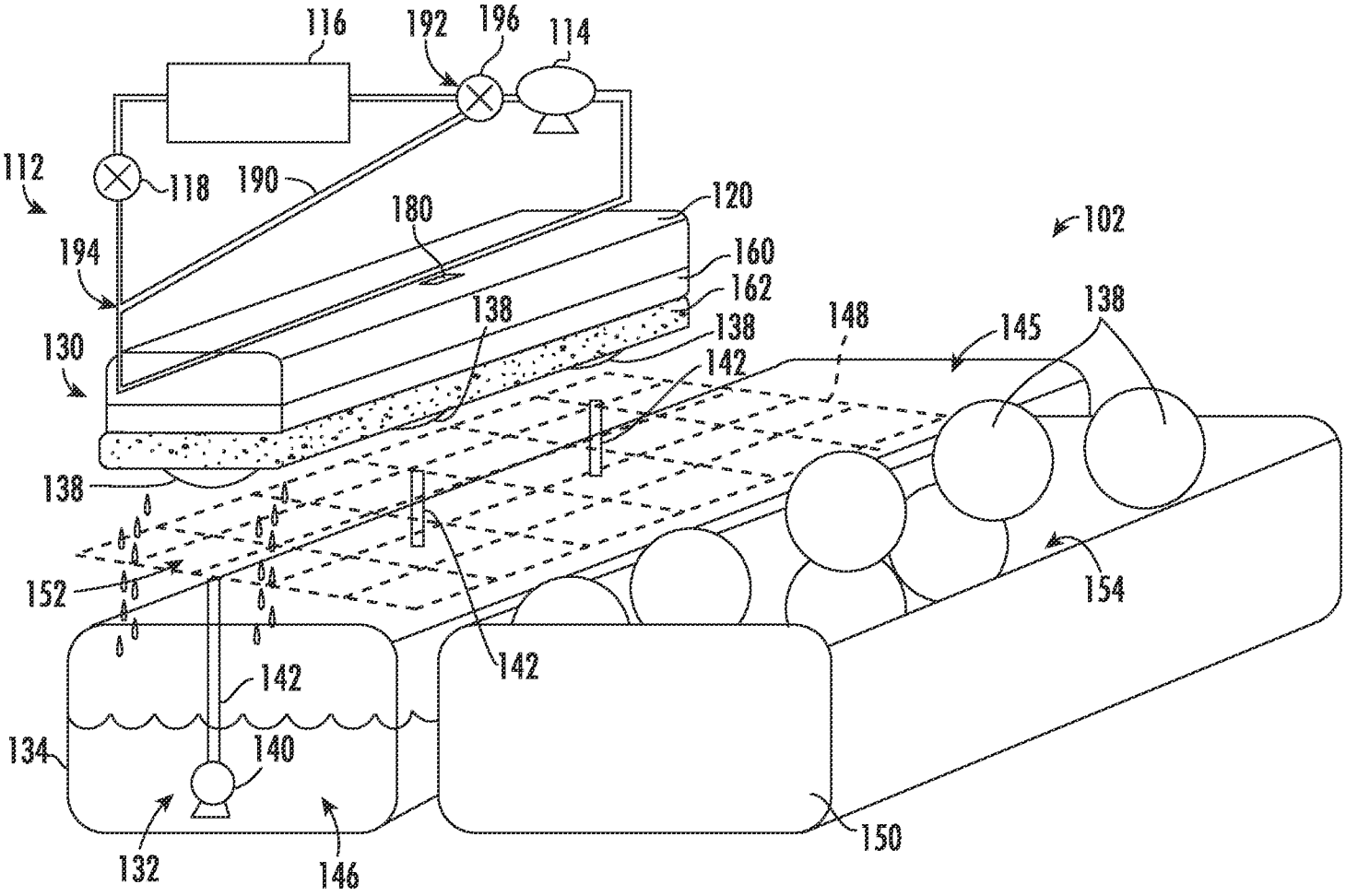
FIG. 3 provides a simplified perspective view of an ice making assembly according to exemplary embodiments of the present disclosure.

Turning now to the figures, FIG. 1 provides a side plan view of an ice making appliance 100, including an ice making assembly 102. FIG. 2 provides a schematic view of ice making assembly 102. FIG. 3 provides a simplified perspective view of ice making assembly 102. Generally, ice making appliance 100 includes a cabinet 104 (e.g., insulated housing) and defines a mutually orthogonal vertical direction V, lateral direction, and transverse direction. The lateral direction and transverse direction may be generally understood to be horizontal directions H.

As shown, cabinet 104 defines one or more chilled chambers, such as a freezer chamber 106. In certain embodiments, such as those illustrated by FIG. 1, ice making appliance 100 is understood to be formed as, or as part of, a stand-alone freezer appliance. It is recognized, however, that additional or alternative embodiments may be provided within the context of other refrigeration appliances. For instance, the benefits of the present disclosure may apply to any type or style of a refrigerator appliance that includes a freezer chamber (e.g., a top mount refrigerator appliance, a bottom mount refrigerator appliance, a side-by-side style refrigerator appliance, etc.). Consequently, the description set forth herein is for illustrative purposes only and is not intended to be limiting in any aspect to any particular chamber configuration.

Ice making appliance 100 generally includes an ice making assembly 102 on or within freezer chamber 106. In some embodiments, ice making appliance 100 includes a door 105 that is rotatably attached to cabinet 104 (e.g., at a top portion thereof). As would be understood, door 105 may selectively cover an opening defined by cabinet 104. For instance, door 105 may rotate on cabinet 104 between an open position (not pictured) permitting access to freezer chamber 106 and a closed position (FIG. 2) restricting access to freezer chamber 106.

A user interface panel 108 is provided for controlling the mode of operation. For example, user interface panel 108 may include a plurality of user inputs (not labeled), such as a touchscreen or button interface, for selecting a desired mode of operation. Operation of ice making appliance 100 can be regulated by a controller 110 that is operatively coupled to user interface panel 108 or various other components, as will be described below. User interface panel 108 provides selections for user manipulation of the operation of ice making appliance 100 such as (e.g., selections regarding chamber temperature, ice making speed, or other various options). In response to user manipulation of user interface panel 108, or one or more sensor signals, controller 110 may operate various components of the ice making appliance 100 or ice making assembly 102.

Controller 110 may include a memory (e.g., non-transitive memory) and one or more microprocessors, CPUs or the like, such as general or special purpose microprocessors operable to execute programming instructions or micro-control code associated with operation of ice making appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 110 may be constructed without using a microprocessor (e.g., using a combination of discrete analog or digital logic circuitry; such as switches, amplifiers, integrators, comparators, flip-flops, AND gates, and the like; to perform control functionality instead of relying upon software).

Controller 110 may be positioned in a variety of locations throughout ice making appliance 100. In optional embodiments, controller 110 is located within the user interface panel 108. In other embodiments, the controller 110 may be positioned at any suitable location within ice making appliance 100, such as for example within cabinet 104. Input/output ("I/O") signals may be routed between controller 110 and various operational components of ice making appliance 100. For example, user interface panel 108 may be in communication with controller 110 via one or more signal lines or shared communication busses.

As illustrated, controller 110 may be in communication with the various components of ice making assembly 102 and may control operation of the various components. For example, various valves, switches, etc. may be actuatable based on commands from the controller 110. As discussed, user interface panel 108 may additionally be in communication with the controller 110. Thus, the various operations may occur based on user input or automatically through controller 110 instruction.

Figure 4:
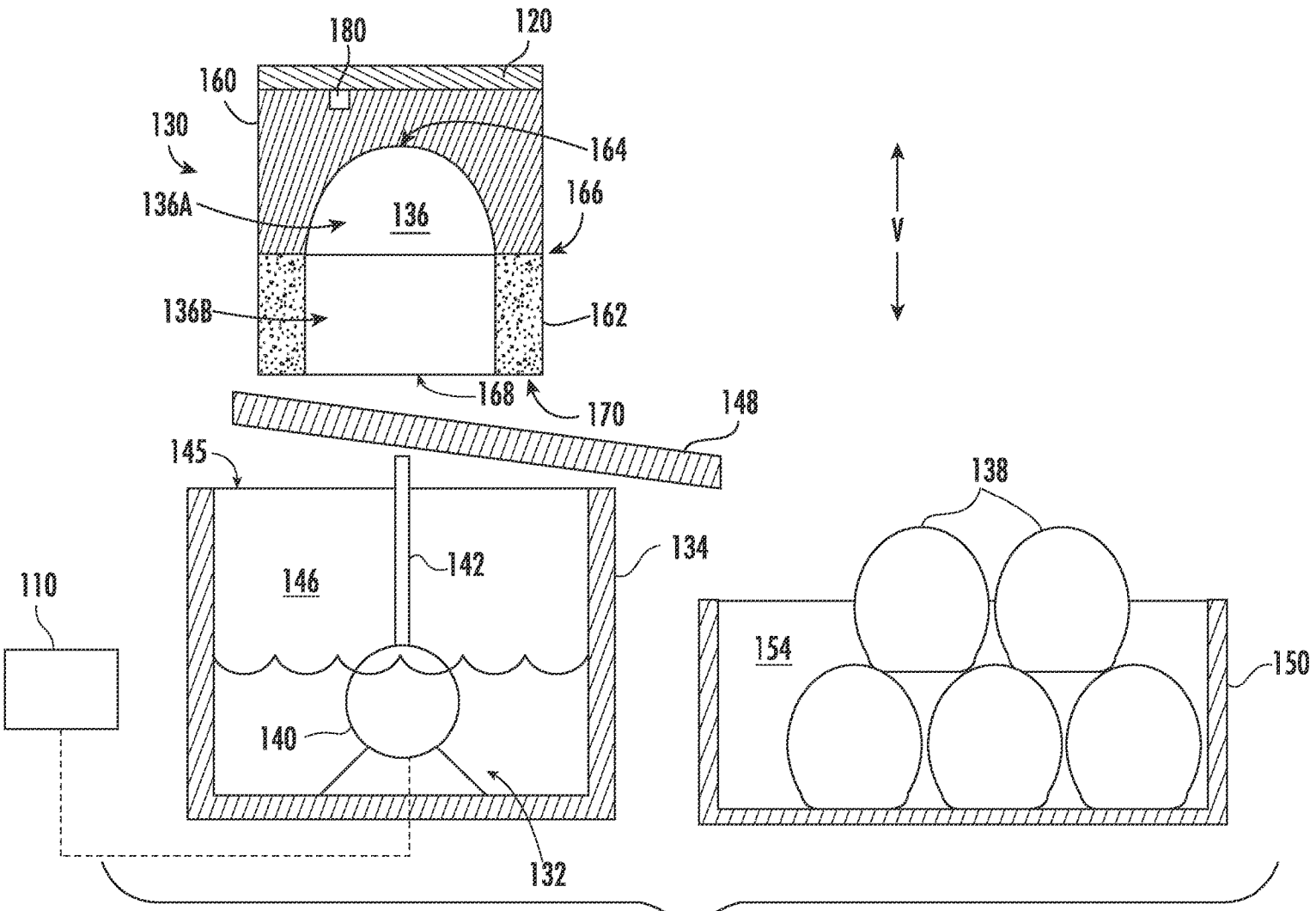
FIG. 4 provides a cross-sectional, schematic view of the exemplary ice making assembly of FIG. 3.

Generally, as shown in FIGS. 3 and 4, ice making appliance 100 includes a sealed refrigeration system 112 for executing a vapor compression cycle for cooling water within ice making appliance 100 (e.g., within freezer chamber 106). Sealed refrigeration system 112 includes a compressor 114, a condenser 116, an expansion device 118, and an evaporator 120 connected in fluid series and charged with a refrigerant. As will be understood by those skilled in the art, sealed refrigeration system 112 may include additional components (e.g., one or more directional flow valves or an additional evaporator, compressor, expansion device, or condenser). Moreover, at least one component (e.g., evaporator 120) is provided in thermal communication (e.g., conductive thermal communication) with an ice mold or mold assembly 130 (FIG. 3) to cool mold assembly 130, such as during ice making operations. Optionally, evaporator 120 is mounted within freezer chamber 106.

Within sealed refrigeration system 112, gaseous refrigerant flows into compressor 114, which operates to increase the pressure of the refrigerant. This compression of the refrigerant raises its temperature, which is lowered by passing the gaseous refrigerant through condenser 116. Within condenser 116, heat exchange with ambient air takes place so as to cool the refrigerant and cause the refrigerant to condense to a liquid state.

Expansion device 118 (e.g., a mechanical valve, capillary tube, electronic expansion valve, or other restriction device) receives liquid refrigerant from condenser 116. From expansion device 118, the liquid refrigerant enters evaporator 120. Upon exiting expansion device 118 and entering evaporator 120, the liquid refrigerant drops in pressure and vaporizes. Due to the pressure drop and phase change of the refrigerant, evaporator 120 is cool relative to freezer chamber 106. As such, cooled water and ice or air is produced and refrigerates ice making appliance 100 or freezer chamber 106. Thus, evaporator 120 is a heat exchanger which transfers heat from water or air in thermal communication with evaporator 120 to refrigerant flowing through evaporator 120.

Optionally, as described in more detail below, one or more directional valves may be provided (e.g., between compressor 114 and condenser 116) to selectively redirect refrigerant through a bypass line connecting the directional valve or valves to a point in the fluid circuit downstream from the expansion device 118 and upstream from the evaporator 120. In other words, the one or more directional valves may permit refrigerant to selectively bypass the condenser 116 and expansion device 120.

In additional or alternative embodiments, ice making appliance 100 further includes a supply valve 122 for regulating a flow of liquid water to ice making assembly 102. For example, supply valve 122 may be selectively adjustable between an open configuration and a closed configuration. In the open configuration, supply valve 122 permits a flow of liquid water to ice making assembly 102 (e.g., to a pump assembly 132 or a water basin 134 of ice making assembly 102). Conversely, in the closed configuration, supply valve 122 hinders the flow of liquid water to ice making assembly 102. However, it should be appreciated that certain exemplary embodiments require no supply valve at all.

In certain embodiments, ice making appliance 100 also includes a discrete chamber cooling system 124 (e.g., separate from sealed refrigeration system 112) to generally draw heat from within freezer chamber 106. For example, discrete chamber cooling system 124 may include a corresponding sealed refrigeration circuit (e.g., including a unique compressor, condenser, evaporator, and expansion device) or air handler (e.g., axial fan, centrifugal fan, etc.) configured to motivate a flow of chilled air within freezer chamber 106. According to an exemplary embodiment, a second evaporator may be tied into the chamber cooling system 124 or sealed cooling system 124.

Turning now to FIGS. 3 and 4, FIG. 4 provides a cross-sectional, schematic view of ice making assembly 102. As shown, ice making assembly 102 includes a mold assembly 130 that defines a mold cavity 136 within which an ice billet 138 may be formed. Optionally, a plurality of mold cavities 136 may be defined by mold assembly 130 and spaced apart from each other (e.g., perpendicular to the vertical direction V). One or more portions of sealed refrigeration system 112 may be in thermal communication with mold assembly 130. In particular, evaporator 120 may be placed on or in contact (e.g., conductive contact) with a portion of mold assembly 130. During use, evaporator 120 may selectively draw heat from mold cavity 136, as will be further described below. Moreover, a pump assembly 132 positioned below mold assembly 130 may selectively direct the flow of water into mold cavity 136. Generally, pump assembly 132 includes a circulation pump 140 and at least one nozzle 142 directed (e.g., vertically) toward mold cavity 136. In embodiments wherein multiple discrete mold cavities 136 are defined by mold assembly 130, pump assembly 132 may include a plurality of nozzles 142 or fluid pumps vertically aligned with the plurality mold cavities 136. For instance, each mold cavity 136 may be vertically aligned with a discrete nozzle 142.

In some embodiments, a water basin 134 is positioned below the ice mold (e.g., directly beneath mold cavity 136 along the vertical direction V). Water basin 134 includes a solid nonpermeable body and may define a vertical opening 145 and interior volume 146 in fluid communication with mold cavity 136. When assembled, fluids, such as excess water falling from mold cavity 136, may pass into interior volume 146 of water basin 134 through vertical opening 145. In certain embodiments, one or more portions of pump assembly 132 are positioned within water basin 134 (e.g., within interior volume 146). As an example, circulation pump 140 may be mounted within water basin 134 in fluid communication with interior volume 146. Thus, circulation pump 140 may selectively draw water from interior volume 146 (e.g., to be dispensed by spray nozzle 142). Nozzle 142 may extend (e.g., vertically) from circulation pump 140 through interior volume 146.

In optional embodiments, a guide ramp 148 is positioned between mold assembly 130 and water basin 134 along the vertical direction V. For example, guide ramp 148 may include a ramp surface that extends at a negative angle (e.g., relative to a horizontal direction) from a location beneath mold cavity 136 to another location spaced apart from water basin 134 (e.g., horizontally). In some such embodiments, guide ramp 148 extends to or terminates above an ice bin 150. Additionally or alternatively, guide ramp 148 may define a perforated portion 152 that is, for example, vertically aligned between mold cavity 136 and nozzle 142 or between mold cavity 136 and interior volume 146. One or more apertures are generally defined through guide ramp 148 at perforated portion 152. Fluids, such as water, may thus generally pass through perforated portion 152 of guide ramp 148 (e.g., along the vertical direction V between mold cavity 136 and interior volume 146). It should be appreciated that according to alternative embodiments, any suitable apparatus for separating falling liquid water from falling ice may be used.

As shown, ice bin 150 generally defines a storage volume 154 and may be positioned below mold assembly 130 and mold cavity 136. Ice billets 138 formed within mold cavity 136 may be expelled from mold assembly 130 and subsequently stored within storage volume 154 of ice bin 150 (e.g., within freezer chamber 106). In some such embodiments, ice bin 150 is positioned within freezer chamber 106 and horizontally spaced apart from water basin 134, pump assembly 132, or mold assembly 130. Guide ramp 148 may span the horizontal distance between mold assembly 130 and ice bin 150. As ice billets 138 descend or fall from mold cavity 136, the ice billets 138 may thus be motivated (e.g., by gravity) toward ice bin 150.

Figure 5:
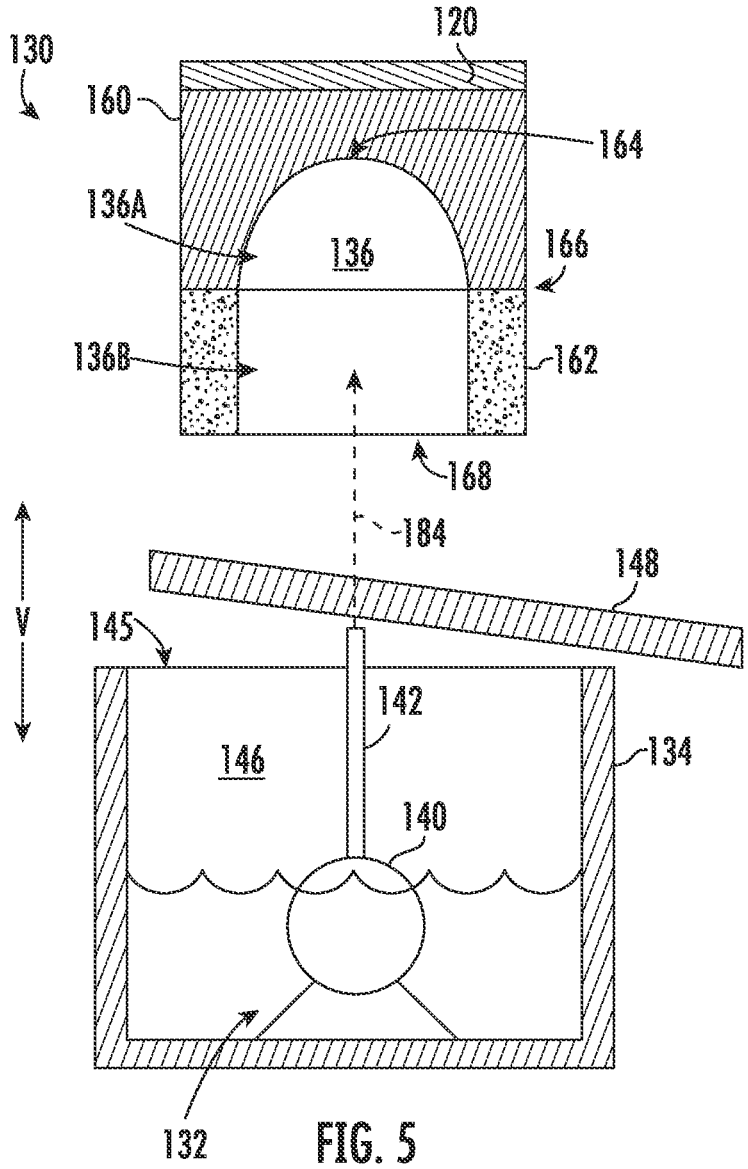
FIG. 5 provides a cross-sectional, schematic view of a portion of the exemplary ice making assembly of FIG. 3 during an ice forming operation.

Turning now generally to FIGS. 4 and 5, exemplary ice forming operations of ice making assembly 102 will be described. As shown, mold assembly 130 is formed from discrete conductive ice mold 160 and insulation jacket 162. Generally, insulation jacket 162 extends downward from (e.g., directly from) conductive ice mold 160. For instance, insulation jacket 162 may be fixed to conductive ice mold 160 through one or more suitable adhesives or attachment fasteners (e.g., bolts, latches, mated prongs-channels, etc.) positioned or formed between conductive ice mold 160 and insulation jacket 162.

Together, conductive ice mold 160 and insulation jacket 162 may define mold cavity 136. For instance, conductive ice mold 160 may define an upper portion 136A of mold cavity 136 while insulation jacket 162 defines a lower portion 136B of mold cavity 136. Upper portion 136A of mold cavity 136 may extend between a nonpermeable top end 164 and an open bottom end 166. Additionally or alternatively, upper portion 136A of mold cavity 136 may be curved (e.g., hemispherical) in open fluid communication with lower portion 136B of mold cavity 136. Lower portion 136B of mold cavity 136 may be a vertically open passage that is aligned (e.g., in the vertical direction V) with upper portion 136A of mold cavity 136. Thus, mold cavity 136 may extend along the vertical direction between a mold opening 168 at a bottom portion or bottom surface 170 of insulation jacket 162 to top end 164 within conductive ice mold 160. In some such embodiments, mold cavity 136 defines a constant diameter or horizontal width from lower portion 136B to upper portion 136A. When assembled, fluids, such as water may pass to upper portion 136A of mold cavity 136 through lower portion 136B of mold cavity 136 (e.g., after flowing through the bottom opening defined by insulation jacket 162).

Conductive ice mold 160 and insulation jacket 162 are formed, at least in part, from two different materials. Conductive ice mold 160 is generally formed from a thermally conductive material (e.g., metal, such as copper, aluminum, or stainless steel, including alloys thereof) while insulation jacket 162 is generally formed from a thermally insulating material (e.g., insulating polymer, such as a synthetic silicone configured for use within subfreezing temperatures without significant deterioration). According to alternative embodiments, insulation jacket 162 may be formed using polyethylene terephthalate (PET) plastic or any other suitable material. In some embodiments, conductive ice mold 160 is formed from material having a greater amount of water surface adhesion than the material from which insulation jacket 162 is formed. Water freezing within mold cavity 136 may be prevented from extending horizontally along bottom surface 170 of insulation jacket 162.

Advantageously, an ice billet within mold cavity 136 may be prevented from mushrooming beyond the bounds of mold cavity 136. Moreover, if multiple mold cavities 136 are defined within mold assembly 130, ice making assembly 102 may advantageously prevent a connecting layer of ice from being formed along the bottom surface 170 of insulation jacket 162 between the separate mold cavities 136 (and ice billets therein). Further advantageously, the present embodiments may ensure an even heat distribution across an ice billet within mold cavity 136. Cracking of the ice billet or formation of a concave dimple at the bottom of the ice billet may thus be prevented.

In some embodiments, the unique materials of conductive ice mold 160 and insulation jacket 162 each extend to the surfaces defining upper portion 136A and lower portion 136B of mold cavity 136. In particular, a material having a relatively high water adhesion may define the bounds of upper portion 136A of mold cavity 136 while a material having a relatively low water adhesion defines the bounds of lower portion 136B of mold cavity 136. For instance, the surface of insulation jacket 162 defining the bounds of lower portion 136B of mold cavity 136 may be formed from an insulating polymer (e.g., silicone). The surface of conductive mold cavity 136 defining the bounds of upper portion 136A of mold cavity 136 may be formed from a thermally conductive metal (e.g., aluminum or copper). In some such embodiments, the thermally conductive metal of conductive ice mold 160 may extend along (e.g., the entirety of) of upper portion 136A.

Although an exemplary mold assembly 130 is described above, it should be appreciated that variations and modifications may be made to mold assembly 130 while remaining within the scope of the present subject matter. For example, the size, number, position, and geometry of mold cavities 136 may vary. In addition, according to alternative embodiments, an insulation film may extend along and define the bounds of upper portion 136A of mold cavity 136, e.g., may extend along an inner surface of conductive ice mold 160 at upper portion 136A of mold cavity 136. Indeed, aspects of the present subject matter may be modified and implemented in a different ice making apparatus or process while remaining within the scope of the present subject matter.

In some embodiments, one or more sensors are mounted on or within ice mold 160 or in other locations within ice making appliance 100. As an example, a temperature sensor 180 may be mounted adjacent to ice mold 160. Temperature sensor 180 may be electrically coupled to controller 110 and configured to detect the temperature at various locations within ice mold 160. Temperature sensor 180 may be formed as any suitable temperature detecting device, such as a thermocouple, thermistor, etc. Although temperature sensor 180 is illustrated as being mounted to ice mold 160, it should be appreciated that according to alternative embodiments, temperature sensor may be positioned at any other suitable location for providing data indicative of the temperature of the ice mold 160. For example, temperature sensor 180 may alternatively be mounted to a coil of evaporator 120 or at any other suitable location within ice making appliance 100.

As shown, controller 110 may be in communication (e.g., electrical communication) with one or more portions of ice making assembly 102. In some embodiments, controller 110 is in communication with one or more fluid pumps (e.g., circulation pump 140), compressor 114, flow regulating valves, etc. Controller 110 may be configured to initiate discrete ice making operations and ice release operations. For instance, controller 110 may alternate the fluid source spray to mold cavity 136 and a release or ice harvest process, which will be described in more detail below.

During ice making operations, controller 110 may initiate or direct pump assembly 132 to motivate an ice-building spray (e.g., as indicated at arrows 184) through nozzle 142 and into mold cavity 136 (e.g., through mold opening 168). Controller 110 may further direct sealed refrigeration system 112 (e.g., at compressor 114) (FIG. 3) to motivate refrigerant through evaporator 120 and draw heat from within mold cavity 136. As the water from the ice-building spray 184 strikes mold assembly 130 within mold cavity 136, a portion of the water may freeze in progressive layers from top end 164 to bottom end 166. Excess water (e.g., water within mold cavity 136 that does not freeze upon contact with mold assembly 130 or the frozen volume herein) and impurities within the ice-building spray 184 may fall from mold cavity 136 and, for example, to water basin 134.

Once ice billets 138 are formed within mold cavity 136, an ice release or harvest process may be performed in accordance with embodiments of the present subject matter. Specifically, referring again to FIG. 3, sealed system 112 may further include a bypass conduit 190 that is fluidly coupled to refrigeration loop or sealed system 112 for routing a portion of the flow of refrigerant around condenser 116. In this manner, by selectively regulating the amount of relatively hot refrigerant flow that exits compressor 114 and bypasses condenser 116, the temperature of the flow of refrigerant passing into evaporator 120 may be precisely regulated.

Specifically, according to the illustrated embodiment, bypass conduit 190 extends from a first junction 192 to a second junction 194 within sealed system 112. First junction 192 is located between compressor 114 and condenser 116, e.g., downstream of compressor 114 and upstream of condenser 116. By contrast, second junction 194 is located between condenser 116 and evaporator 120, e.g., downstream of condenser 116 and upstream of evaporator 120. Moreover, according to the illustrated embodiment, second junction 194 is also located downstream of expansion device 118, although second junction 194 could alternatively be positioned upstream of expansion device 118. When plumbed in this manner, bypass conduit 190 provides a pathway through which a portion of the flow of refrigerant may pass directly from compressor 114 to a location immediately upstream of evaporator 120 to increase the temperature of evaporator 120.

Notably, if substantially all of the flow of refrigerant were diverted from compressor 114 through bypass conduit 190 when ice mold 160 is still very cold (e.g., below 10° F. or 20° F.), the thermal shock experienced by ice billets 138 due to the sudden increase in evaporator temperature might cause ice billets 138 to crack. Therefore, controller 110 may implement methods for slowly regulating or precisely controlling the evaporator temperature to achieve the desired mold temperature profile and harvest release time to prevent the ice billets 138 from cracking.

In this regard, for example, bypass conduit 190 may be fluidly coupled to sealed system 112 using a flow regulating device 196. Specifically, flow regulating device 196 may be used to couple bypass conduit 190 to sealed system 112 at first junction 192. In general, flow regulating device 196 may be any device suitable for regulating a flow rate of refrigerant through bypass conduit 190. For example, according to an exemplary embodiment of the present subject matter, flow regulating device 196 is an electronic expansion device which may selectively divert a portion of the flow of refrigerant exiting compressor 114 into bypass conduit 190. According to still another embodiment, flow regulating device 196 may be a servomotor-controlled valve for regulating the flow of refrigerant through bypass conduit 190. According to still other embodiments, flow regulating device 196 may be a three-way valve mounted at first junction 192 or a solenoid-controlled valve operably coupled along bypass conduit 190.

According to exemplary embodiments of the present subject matter, controller 110 may initiate an ice release or harvest process to discharge ice billets 138 from mold cavities 136. Specifically, for example, controller 110 may first halt or prevent the ice-building spray 184 by de-energizing circulation pump 140. Next, controller 110 may regulate the operation of sealed system 112 to slowly increase a temperature of evaporator 120 and ice mold 160. Specifically, by increasing the temperature of evaporator 120, the mold temperature of ice mold 160 is also increased, thereby facilitating partial melting or release of ice billets 138 from mold cavities.

According to exemplary embodiments, controller 110 may be operably coupled to flow regulating device 196 for regulating a flow rate of the flow of refrigerant through bypass conduit 190. Specifically, according to an exemplary embodiment, controller 110 may be configured for obtaining a mold temperature of the mold body using temperature sensor 180. Although the term "mold temperature" is used herein, it should be appreciated that temperature sensor 180 may measure any suitable temperature within the ice making appliance 100 that is indicative of mold temperature and may be used to facilitate improved harvest of ice billets 138.

Controller 110 may further regulate the flow regulating device 196 to control the flow of refrigerant based in part on the measured mold temperature. For example, according to an exemplary embodiment, flow regulating device 196 may be regulated such that a rate of change of the mold temperature does not exceed a predetermined threshold rate. For example, this predetermined threshold rate may be any suitable rate of temperature change beyond which thermal expansion of ice billets 138 may lead to cracking. For example, according to an exemplary embodiment, the predetermined threshold rate may be approximately 1° F. per minute, about 2° F. per minute, about 3° F. per minute, or higher. According to exemplary embodiments, the predetermined threshold rate may be less than 10° F. per minute, less than 5° F. permanent, less than 2° F. per minute, or lower. According to alternative embodiments, any other suitable threshold rate may be used. In this manner, flow regulating device 196 may regulate the rate of temperature change of ice billets 138, thereby preventing cracking due to thermal expansion.

In general, the sealed system 112 and methods of operation described herein are intended to regulate a temperature change of ice billets 138 to prevent cracking due to thermal expansion. However, although specific control algorithms and system configurations are described, it should be appreciated that according to alternative embodiments variations and modifications may be made to such systems and methods while remaining within the scope of the present subject matter. For example, the exact plumbing of bypass conduit 190 may vary, the type or position of flow regulating device 196 may change, and different control methods may be used while remaining within scope of the present subject matter. In addition, depending on the size and shape of ice billets 138, the predetermined threshold rate and predetermined temperature threshold may be adjusted to prevent that particular set of ice billets 138 from cracking, or to otherwise facilitate an improved harvest procedure.

Figure 6:
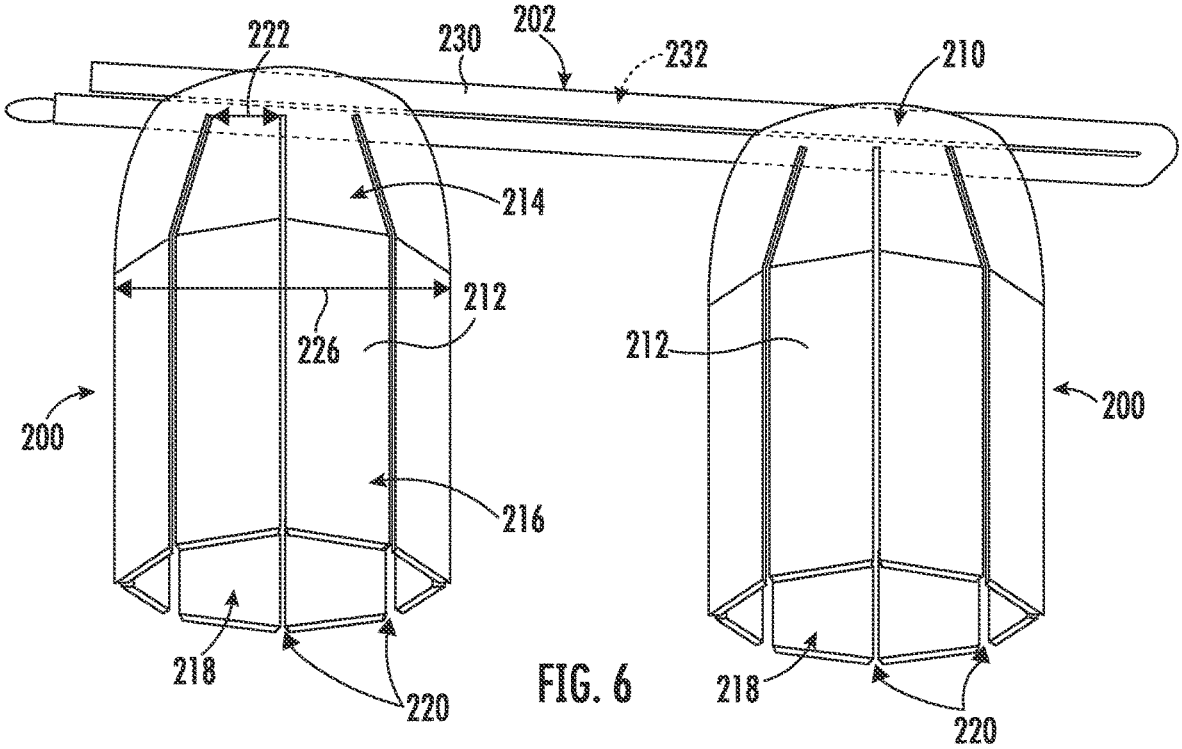
FIG. 6 provides a bottom perspective view of an ice mold and an evaporator assembly according to an exemplary embodiment of the present subject matter.
Figure 7:
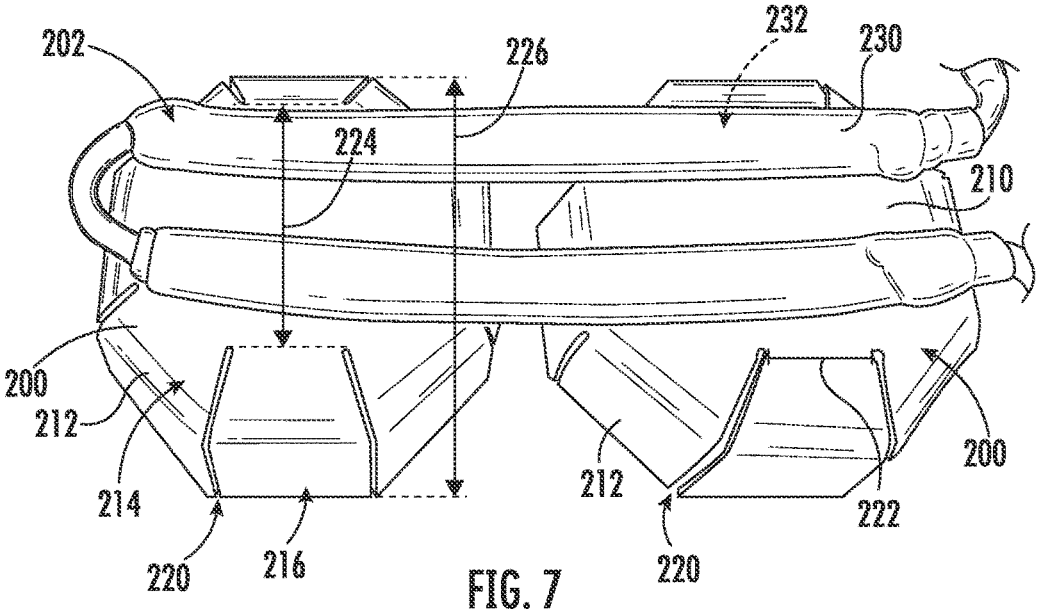
FIG. 7 provides a top perspective view of the exemplary ice mold and evaporator assembly of FIG. 6 according to an exemplary embodiment of the present subject matter.

Referring now specifically to FIGS. 6 and 7, an exemplary ice mold 200 and evaporator assembly 202 that may be used with ice making appliance 100 will be described according to exemplary embodiments of the present subject matter. Specifically, for example, ice mold 200 may be used as mold assembly 130 and evaporator assembly 202 may be used as evaporator 120 of sealed cooling system 112. Although ice mold 200 and evaporator assembly 202 are described herein with respect to ice making appliance 100, it should be appreciated that ice mold 200 and evaporator assembly 202 may be used in any other suitable ice making application or appliance.

As shown, ice mold 200 generally includes a top wall 210 and a plurality of sidewalls 212 that are cantilevered from top wall 210 and extend downward from top wall 210. More specifically, according to the illustrated embodiment, ice mold 200 includes eight sidewalls 212 that include an angled portion 214 that extends away from top wall 210 and a vertical portion 216 that extends down from angled portion 214 substantially along the vertical direction. In this manner, the top wall 210 and the plurality of sidewalls 212 form a mold cavity 218 having an octagonal cross-section when viewed in a horizontal plane. In addition, each of the plurality of sidewalls 212 may be separated by a gap 220 that extends substantially along the vertical direction. In this manner, the plurality of sidewalls 212 may move relative to each other and act as spring fingers to permit some flexing of ice mold 200 during ice formation. Notably, this flexibility of ice mold 200 facilitates improved ice formation and reduces the likelihood of cracking.

In general, ice mold 200 may be formed from any suitable material and in any suitable manner that provides sufficient thermal conductivity to transfer heat to evaporator assembly 202 to facilitate the ice making process. According to an exemplary embodiment, ice mold 200 is formed from a single sheet of copper. In this regard, for example, a flat sheet of copper having a constant thickness may be machined to define top wall 210 and sidewalls 212. Sidewalls 212 may be subsequently bent to form the desired shape of mold cavity 218, e.g., such as the octagonal or gem shape described above. In this manner, top wall 210 and sidewalls 212 may be formed to have an identical thickness without requiring complex and costly machining processes.

According exemplary embodiments of the present subject matter, evaporator assembly 202 is mounted in direct contact with the top wall 210 of ice mold 200. In addition, evaporator assembly 202 may not be in direct contact with sidewalls 212. This may be desirable, for example, to prevent restricting the movement of sidewalls 212, e.g., to reduce to the likelihood of ice cracking. Notably, when evaporator assembly 202 is mounted only on top wall 210, the conductive path to each of the plurality of sidewalls 212 is through the joint or connection where sidewalls 212 meet top wall 210. Thus, it may be desirable to make a sidewall width 222 as large as possible to provide improved thermal conductivity. For example, the sidewall width 222 may be between about 0.5 and 1.5 inches, between about 0.7 and 1 inches, or about 0.8 inches. Such a sidewall width 222 facilitates the conduction of thermal energy to the bottom ends of each of the plurality of sidewalls 212.

In addition, to improve the thermal contact between evaporator assembly 202 and ice mold 200, it may be desirable to make top wall relatively large. Therefore, according to exemplary embodiments, top wall 210 may define a top width 224 and mold cavity 218 may define a max width 226. According to exemplary embodiments, top width 224 is greater than about 50% of max width 226. According to still other embodiments, top width 224 may be greater than about 60%, greater than about 70%, greater than about 80%, or greater, of max width 226. In addition, or alternatively, top width 224 may be less than 90%, less than 70%, less than 60%, less than 50%, or less, of max width 226. It should be appreciated that other suitable sizes, geometries, and configurations of ice mold 200 are possible and within the scope of the present subject matter. In addition, although only two ice molds 200 are illustrated in FIGS. 6 and 7, it should be appreciated that alternative embodiments may include any other suitable number and configuration of ice molds 200.

Referring still to FIGS. 6 and 7, evaporator assembly 202 may generally include a primary evaporator tube 230 and a thermal enhancement structure 232 which is positioned within primary evaporator tube 230. According to an exemplary embodiment, primary evaporator tube may be a copper pipe having a circular cross section. The diameter of primary evaporator tube 230 may be between about 0.1 and 3 inches, between about 0.2 and 2 inches, between about 0.3 and 1 inches, between about 0.4 and 0.8 inches, or about 0.5 inches. However, it should be appreciated that primary evaporator tube 230 may be any other suitable size, shape, length, and material.

As used herein, "thermal enhancement structure" is generally intended to refer to any suitable material, structure, or features within interior of primary evaporator tube 230 which are intended to increase the refrigerant side surface area within primary evaporator tube 230. For example, thermal enhancement structure 232 may be a plurality of internal tubes (not shown) that are stacked within primary evaporator tube 230. In general, these internal tubes may be copper pipes that have a smaller diameter than primary evaporator tube 230. The internal tubes may be stacked in primary evaporator tube 230 and extend approximately the same length as primary evaporator tube 230. It should be appreciated that exemplary embodiments do not require thermal enhancement structure.

According to an exemplary embodiment, the thermal enhancement structure 232 includes greater than 5 tubes, greater than 10 tubes, greater than 15 tubes, greater than 20 tubes, or more. In addition, or alternatively, thermal enhancement structure 232 may include fewer than 50 tubes, fewer than 25 tubes, fewer than 10 tubes, or fewer. The diameter of each internal tube may be between about 0.01 and 0.5 inches, between about 0.04 and 0.2 inches, between about 0.06 and 0.1 inches, or about 0.08 inches. In addition, it should be appreciated that the internal tubes may have different sizes, lengths, or cross sectional shapes, e.g., in order to efficiently and completely fill primary evaporator tube 230.

Alternatively, the thermal enhancement structure 232 may include a copper foam or mesh structure (not shown). Alternatively, thermal enhancement structure 232 may be a porous thermally conductive material, a honeycomb structure, a lattice structure, or any other suitable thermally conductive material that extends from the internal walls of primary evaporator tube 230 through the center of primary evaporator tube 230 to increase the refrigerant side surface area. It should be appreciated that any other suitable thermal enhancement structure 232 may be used while remaining within the scope of the present subject matter.

As shown generally in FIGS. 6 and 7, after thermal enhancement structure 232 is positioned within primary evaporator tube 230, primary evaporator tube 230 may be pressed or otherwise formed into a flattened or noncircular cross sectional shape. In this manner, primary evaporator tube 230 may be placed in direct contact with the top wall 210 of ice mold 200 and may have improved thermal contact with the top wall 210. In addition, the larger contact surface area between the top wall 210 and primary evaporator tube 230 facilitates a simplified brazing or soldering process to join primary evaporator tube 230 with top wall 210. In addition, pressing primary evaporator tube 230 into a noncircular cross section improves the thermal contact between the internal tubes, e.g., to increase the refrigerant side surface area of evaporator assembly 200. Once formed, according to an exemplary embodiment, evaporator assembly 202 may be used with sealed cooling system 112. In this manner, for example, compressor 114 may urge a flow of refrigerant through condenser 116, expansion device 118, and evaporator assembly 202, as described above.

Figure 8:
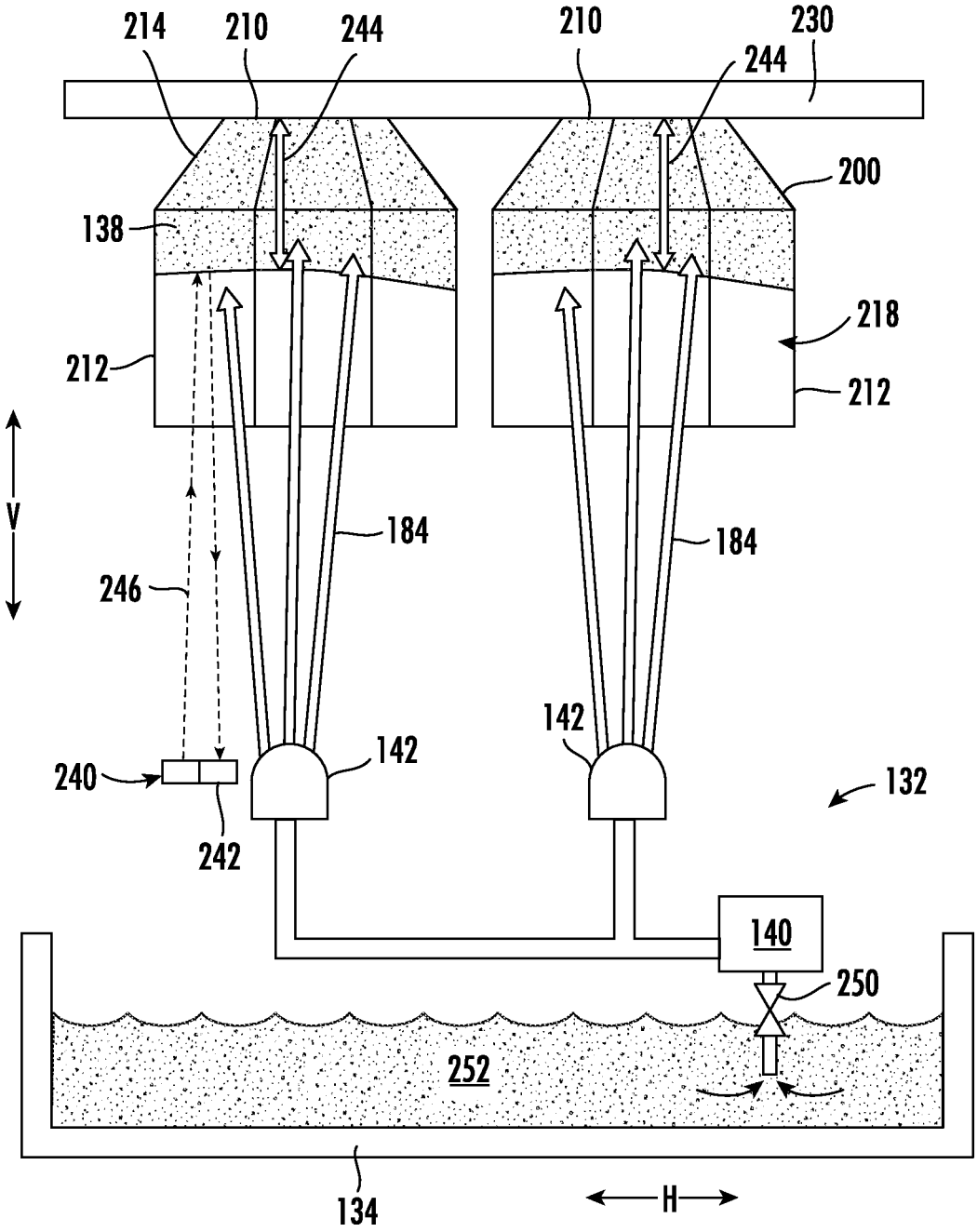
FIG. 8 provides a cross-sectional, schematic view of a portion of the exemplary ice making assembly of FIG. 3 during the early stages of an ice forming operation.
Figure 9:
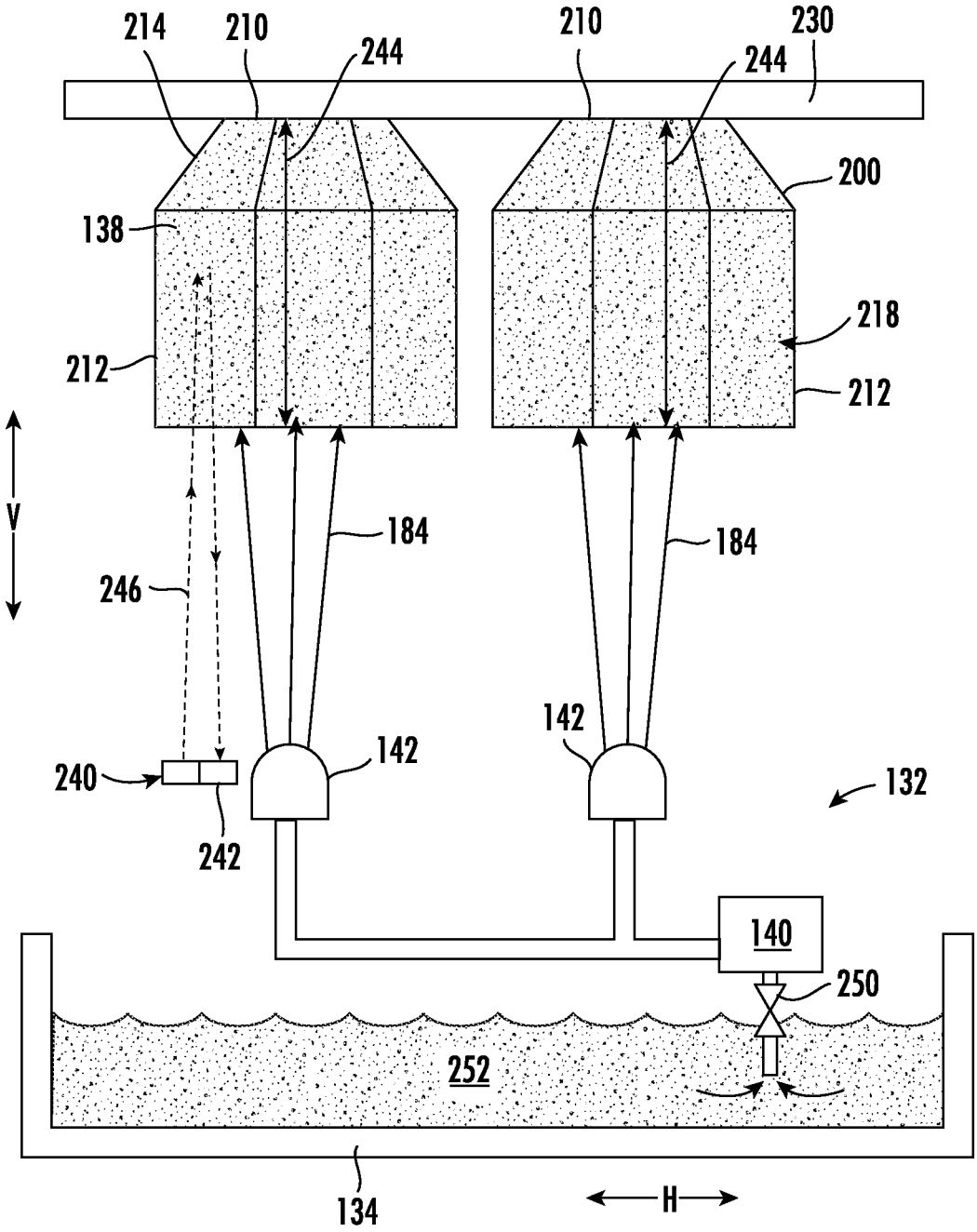
FIG. 9 provides a cross-sectional, schematic view of a portion of the exemplary ice making assembly of FIG. 3 during the later stages of an ice forming operation.

Referring now to FIGS. 8 and 9, pump assembly 132 and associated methods of operation will be described according to exemplary embodiments of the present subject matter. Due to the similarity between the embodiment illustrated in these figures and in the description of ice making appliance 100 above, like reference numerals may be used to refer to the same or similar features. It should be appreciated that the construction and layout of pump assembly 132 as shown in FIGS. 8 and 9 are only exemplary and are intended to facilitate explanation of aspects of the present subject matter. However, the description operation of pump assembly 132 is not intended to limit the scope of the present subject matter in any manner.

As described in more detail below, aspects of the present subject matter are directed to methods for controlling the flow rate and/or velocity of ice-building spray 184, as well as the shape or pattern of the spray, during the formation of ice billet 138. For example, according to exemplary embodiments, the flow rate and/or velocity of ice-building spray 184 may be regulated based at least in part on a size, volume, thickness, or other dimensional measurement of ice billet 138. For example, it may be desirable to progressively decrease the flow rate of ice-building spray 184 as the ice billet forms closer to spray nozzle 142. Therefore, according to exemplary embodiment, ice making appliance 100 may further include a measurement device 240 that is generally configured for detecting such a dimension of ice billet 138. Specifically, according to the illustrated embodiment, measurement device 240 includes one or more optical sensors 242 that are generally configured for detecting a thickness 244 of ice billet 138. In general, optical sensors 242 may transmit and receive a beam of light energy 246 in order to determine the thickness 244 or any other dimensional representation of ice billet 138 or the distance between spray nozzle 142 and ice billet 138. In this regard, during early stages of the ice formation process (e.g., as shown in FIG. 8), ice billet 138 may have a relatively small thickness such that the distance between ice billet 138 and spray nozzle 142 is relatively large. By contrast, during later stages of the ice formation process (e.g., as shown in FIG. 9), ice billet 138 may have a relatively large thickness such that the distance between ice billet 138 and spray nozzle 142 is relatively small. Measurement device 240 may be in operative communication with controller 110 for providing useful data regarding the size of ice billet 138. It should be appreciated that according to alternative embodiments, any other suitable type of distance measuring device may be used, such as an acoustic sensor, a contact sensor, etc.

According to still other embodiments, measurement device 240 could be a temperature sensor, such as a thermocouple, a thermistor, or any other suitable temperature measuring device for measuring a temperature of the mold assembly 130, the ice billet 138, or any other feature or area where the measured temperature has some relation to the thickness of the ice billet 138. For example, a temperature sensor may be embedded in mold assembly 130 such that temperature measurements may be used to approximate the thickness of ice billet 138. Any other suitable number, type, and configuration of temperature measuring devices may be used according to alternative embodiments.

It should be appreciated that pump assembly 132 may include any suitable number, type, and configuration of valves or features for regulating the flow rate and/or velocity of ice-building spray 184. In this regard, as shown for example in FIGS. 8 and 9, pump assembly 132 includes two spray nozzles 142 (e.g., one for each of the two ice molds 200), one circulation pump 140 for urging water through spray nozzles 142 to generate ice-building spray 184, and a flow regulating valve 250 through which circulation pump 140 is fluidly coupled to water basin 134. It should be appreciated that according to exemplary embodiments, any combination of spray nozzles 142, circulation pump(s) 140, and flow regulating valve(s) 250 may be used to regulate the flow rate and/or velocity of ice-building spray 184. For example, spray nozzles 142 may be adjustable, circulation pump 140 may be regulated to operate at different speeds, and/or flow regulating valve 250 may be configured for selectively throttling or regulating the amount or flow rate of water 252 that may be drawn out of water basin 134.

It should be appreciated that the position and operation of spray nozzles 142, circulation pump 140, and flow regulating valve 250 may be adjusted in any suitable manner. For example, according to an exemplary embodiment, the operation of circulation pump 140 may be varied by controlling a voltage or a control signal that is supplied to circulation pump 140. For example, circulation pump 140 may be a DC electric pump and the flow rate generated by circulation pump 140 may be adjusted by manipulating a pulse width modulated control signal that is communicated to circulation pump 140 via controller 110. By contrast, if circulation pump 140 is an AC electric pump, controller 110 may reduce the frequency of the supplied voltage.

Although the discussion below refers to the adjustment of flow rates and/or velocities of ice-building spray 184, it should be appreciated that any suitable means for adjusting those flow rates may be used while remaining the scope of the present subject matter. In addition, it should be appreciated that any suitable number of valves, pumps, and other flow control features may be used. For example, mold assembly 130 may include a plurality of ice molds 200, each of which has a dedicated spray nozzle 142. In addition, each spray nozzle 142 may be supplied by one dedicated pump, or pump assembly 132 may include any suitable number and configuration of pumps and flow regulation features.

Now that the construction of ice making appliance 100 and pump assembly 132 have been described according to exemplary embodiments, an exemplary method 300 of operating an ice making assembly 100 will be described.

Although the discussion below refers to the exemplary method 300 of operating ice making appliance 100, one skilled in the art will appreciate that the exemplary method 300 is applicable to the operation of a variety of other ice making appliances.

Figure 10:
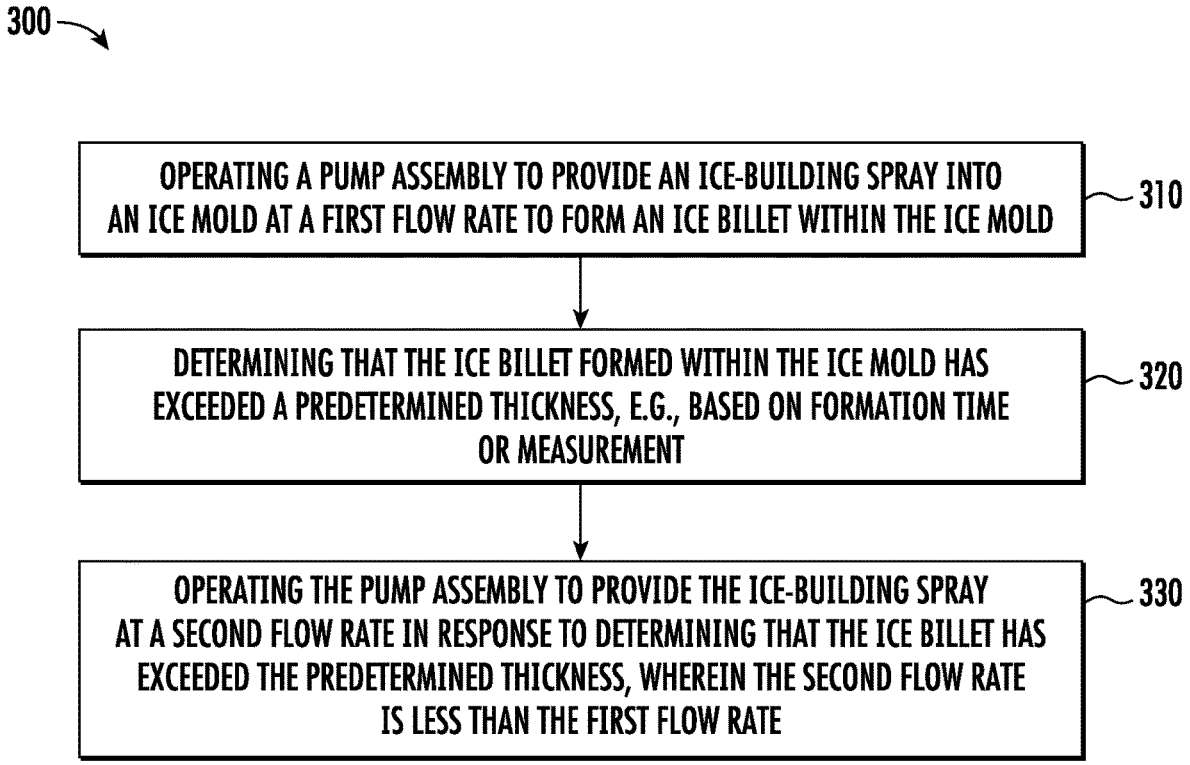
FIG. 10 illustrates a method for operating an ice making assembly according to an exemplary embodiment of the present subject matter.

Referring now to FIG. 10, method 300 includes, at step 310, operating a pump assembly to provide an ice-building spray at a first flow rate to form an ice billet within an ice mold. In this regard, continuing the example from above, pump assembly 132 may urge ice-building spray 184 into ice mold 200 to form ice billet 138. It should be appreciated that the first flow rate may vary as needed depending on the particular application and operating parameters of ice making appliance 100. In addition, as described above, it should be appreciated that the first flow rate may be regulated by any or all subcomponents of pump assembly 132, such as spray nozzles 142, circulation pump 140, flow regulating valve 250, or any other suitable component of pump assembly 132.

Notably, as explained above, ice billet 138 begins forming at a top end 164 of ice mold 200 and/or along the sides of ice mold 200. As circulation pump 140 continues to urge ice-building spray 184 toward ice billet 138, ice billet 138 is slowly formed or developed downward toward spray nozzle 142. However, as ice billet 138 gets closer to spray nozzle 142, ice-building spray 184 may have a tendency to form a hole or otherwise dislodge portions of ice billet 138. Therefore, it may be desirable to reduce the flow rate and/or velocity of ice-building spray 184 as the thickness 244 of ice billet 138 increases. Alternatively, according to an exemplary embodiment, it may be desirable to increase the flow rate as the ice grows to achieve the desired spray pattern.

Specifically, step 320 includes determining that the ice billet formed within the ice mold has exceeded a predetermined thickness. Thus, ice making appliance 100 may monitor the thickness 244 of ice billet 138 to determine how close ice billet 138 is to spray nozzle 142. Notably, as described briefly above, the thickness 244 of ice billet 138 may be measured using a measurement device 240 that is in operative communication with controller 110. By contrast, the thickness 244 of ice billet 138 or the distance between spray nozzle 142 and the bottom of ice billet 138 may be approximated based on the amount of time that ice has been forming within ice mold 200. In this regard, step of determining that the ice billet formed with an ice mold has exceeded the predetermined thickness may include starting the timer when the formation of the ice billet commences and determining that the timer has reached a predetermined formation time, e.g., a time that has been empirically determined as developing a particular thickness of ice billet 138. It should be appreciated that the ice formation time may commence immediately when circulation pump 140 starts or after a period of time has passed since circulation pump 140 or sealed system 112 has started operating, e.g., to provide time for evaporator 120 to lower the temperature of ice mold 200 to a temperature suitable for forming ice. It should be appreciated that other methods for determining the thickness of ice may be used while remaining within scope the present subject matter.

Step 330 includes operating the pump assembly to provide ice-building spray a second flow rate in response to determining that the ice billet has exceeded the predetermined thickness. According to exemplary embodiments, the second flow rate is less than the first flow rate. In this regard, for example, the second flow rate may be between about 10% and 90%, between about 20% and 80%, between about 30% and 70%, between about 40% and 60%, or about 50% of the first flow rate. As explained above, this increased or decreased flow rate is intended to avoid the formation of a bore within ice billet 138 or to otherwise prevent dislodging or melting of ice billet 138. Although exemplary relative flow rates are described herein, it should be appreciated that these rates may vary while remaining within the scope of the present subject matter.

In addition, steps 310 through 330 describe a two-step flow rate adjustment, where the flow rate is changed from a high flow rate to a lower flow rate at a certain thickness threshold. However, it should be appreciated that according to alternative embodiments, the flow rate of ice-building spray 184 may vary incrementally in any suitable number of stages based on any suitable number of thicknesses or may vary progressively as the thickness of ice billet 138 increases. Thus, for example, the flow rate and/or velocity of ice-building spray 184 may vary linearly with the ice formation time, with the highest flow rate at the beginning of the ice formation time in the lowest flow rate at the end of the ice formation, or vice versa.

In addition to adjusting the flow rate and/or velocity of ice-building spray 184, it should be appreciated that pump assembly 132 may be manipulated to control the shape or pattern of ice-building spray 184. For example, during the early stages of ice formation process, the shape or pattern may be more directed or linear toward a top end 164 of ice mold 200. By contrast, during later stages of ice formation process when ice billet 138 is thicker, the spray pattern of ice-building spray 184 may be more dispersed, e.g., to prevent the potential for boring a hole in ice billet 138. As explained herein, this spray pattern may be varied by increasing or decreasing the flow rate of water. Notably, the spray pattern may be achieved in any suitable manner, for example, spray nozzle 142 may be an adjustable nozzle that is operably coupled with controller 110 to adjust the spray pattern during operation. By contrast, spray nozzle 142 may be designed to adjust the flow pattern based on the flow rate passing therethrough. Thus, for example, as ice-building spray 184 decreases in velocity, the shape or pattern of ice-building spray may change accordingly. According to alternative exemplary embodiments, the flow rate may remain the same throughout the ice formation process and the spray pattern may be adjusting in other manners.

Ice making assembly 100 may further be configured for facilitating an improved ice harvesting process. In this regard, for example, controller 110 may be in operative communication with pump assembly 132 and sealed cooling system 112 to improve the shape and finish of the formed ice billet and facilitate improved harvesting or releasing from ice mold 200 without risk of cracking or the introduction of impurities. In this regard, according to an exemplary embodiment, controller 110 may be configured for determining that formation of the ice billet is complete. For example, controller 110 may determine that ice billet 140 has completely formed by using measurement device 240 to measure thickness 244 of ice billet 138. If thickness 244 exceeds some predetermined completion thickness, e.g., when ice billet 138 completely fills ice mold 200, controller 110 may determine that ice billet 138 has been formed. It should be appreciated that controller 110 may determine that ice billet has been formed in any other suitable manner, such as a time-based determination, temperature measurements, etc.

After controller 110 determines that formation of ice billet 138 is complete, it may initiate a harvest process through which ice billet 138 is removed from ice mold. This harvest process may include, for example, slowly raising the temperature of ice mold 200. In this regard, as explained in detail above, controller 110 may operate flow regulating device 196 to slowly divert high temperature refrigerant through bypass conduit 190 to heat ice mold 200. This may be done at a very slow rate to reduce the likelihood of cracking ice billet 138.

The harvest process may further include operating the pump assembly to provide the ice-building spray at a third flow rate to remove at least a portion of the ice billet. In this regard, for example, pump assembly 132 may be regulated to adjust the spray pattern, velocity, flow rate, etc. of the flow of ice building spray 184. As the temperature of the ice building spray 184 increases, e.g., due to heating ice mold 200 and/or due to operation of chamber cooling system 124, the relatively warm water may begin melting, chipping, or otherwise removing portions of ice billet 138 such that a bottom of the resulting ice billet 138 is smoother, slides easier against guide ramp 148, or has an otherwise improved or desirable geometry. It should be appreciated that the third flow rate may be increased, decreased, or otherwise varied relative to the first flow rate and the second flow rate described above. In addition, any other variation or modification to the operation of pump assembly 132 for improved harvest are possible and within the scope of the present subject matter.

FIG. 10 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 300 are explained using ice making appliance 100 and pump assembly 132 as an example, it should be appreciated that these methods may be applied to the operation of any pump assembly or an ice making appliance having any other suitable configuration.

The ice making appliance 100 described above facilitates the timely creation of large, clear ice cubes or billets with minimal cloudiness and imperfections based at least in part based on careful regulation of the flow rate and velocity of an ice-building spray. In this regard, for example, insufficient flow at the beginning of the cycle when there is no ice in the mold may cause cloudy or frosty spots in the ice billet. Therefore, at the beginning of the cycle, it may be desirable to have a water velocity that reaches the top of the evaporator cup or mold cavity and allows some water to wash across the surface. By contrast, a concentrated flow rate and high velocity at the end of the cycle, when the ice is closer to the bottom of the mold and the spray nozzle, may bore a hole within the ice billet or otherwise dislodging portions of ice. Therefore, at the end of the cycle, it may be desirable to lower the flow rate and/or the velocity of the ice-building spray or expand the pattern of the spray (to reduce the concentration), e.g., because as the ice forms, the bottom of the ice billet is closer to the water jet and there is a large layer of ice separating and insulating the water stream and the refrigerant tube. In this regard, ice making appliance 100 may generally be configured for reducing the water flow rate and/or velocity as the thickness of the ice billet increases.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly comprising:
- an ice mold defining a mold cavity;
- a pump assembly comprising an adjustable spray nozzle positioned below the ice mold for urging an ice-building spray into the ice mold; and
- a controller in operative communication with the pump assembly, the controller being configured to:
  - operate the pump assembly to provide the ice-building spray at a first flow rate to form an ice billet within the ice mold;
  - determine that the ice billet formed within the ice mold has exceeded a predetermined thickness;
  - operate the pump assembly to provide the ice-building spray at a second flow rate in response to determining that the ice billet has exceeded the predetermined thickness, wherein the second flow rate is different than the first flow rate; and
  - adjust a shape or pattern of the ice-building spray by adjusting the adjustable spray nozzle.

2. The ice making assembly of claim 1, wherein determining that the ice billet formed within the ice mold has exceeded a predetermined thickness comprises:
- starting a timer when formation of the ice billet commences; and
- determining that the timer has reached a predetermined formation time.

3. The ice making assembly of claim 1, wherein determining that the ice billet formed within the ice mold has exceeded a predetermined thickness comprises:
- measuring a thickness of the ice billet using a measurement device.

4. The ice making assembly of claim 1, wherein the pump assembly comprises:
- a flow regulating valve, and wherein a flow rate of the ice-building spray is adjusted by regulating the flow regulating valve.

5. The ice making assembly of claim 1, wherein the pump assembly comprises a circulation pump, and wherein a flow rate of the ice-building spray is adjusted by adjusting a voltage or a control signal supplied to the circulation pump.

6. The ice making assembly of claim 1,
- wherein adjusting the shape or a pattern of the ice-building spray further comprises adjusting the flow rate of the ice-building spray through the adjustable spray nozzle.

7. The ice making assembly of claim 1, wherein the flow rate of the ice-building spray is decreased in stages or progressively as a thickness of the ice billet increases.

8. The ice making assembly of claim 1, wherein the ice mold defines a plurality of mold cavities and the pump assembly comprises a plurality of spray nozzles, each of the plurality of spray nozzles directing the ice-building spray toward one of the plurality of mold cavities.

9. The ice making assembly of claim 1, wherein the pump assembly comprises:
- a circulation pump for circulating water to generate the ice-building spray.

10. The ice making assembly of claim 1, further comprising:

a refrigeration loop comprising a condenser and an evaporator in serial flow communication with each other, the evaporator being in thermal communication with the ice mold; and a compressor operably coupled to the refrigeration loop and being configured for circulating a flow of refrigerant through the refrigerant loop to cool the evaporator.

11. The ice making assembly of claim 1, wherein the controller is further configured to:

determine that formation of the ice billet is complete;

warm the ice mold; and operate the pump assembly to provide the ice-building spray at a third flow rate to remove at least a portion of the ice billet.

12. The ice making assembly of claim 11, wherein determining that formation of the ice billet is complete comprises:

determining that a thickness of the ice billet exceeds a completion thickness.

13. A method of forming an ice billet using an ice making assembly, the ice making assembly comprising an ice mold and a pump assembly for urging an ice-building spray into the ice mold, the pump assembly comprising an adjustable spray nozzle, the method comprising:

operating the pump assembly to provide the ice-building spray at a first flow rate to form an ice billet within the ice mold;

determining that the ice billet formed within the ice mold has exceeded a predetermined thickness;

operating the pump assembly to provide the ice-building spray at a second flow rate in response to determining that the ice billet has exceeded the predetermined thickness, wherein the second flow rate is different than the first flow rate; and adjusting a shape or pattern of the ice-building spray by adjusting the adjustable spray nozzle.

14. The method of claim 13, wherein determining that the ice billet formed within the ice mold has exceeded a predetermined thickness comprises:

starting a timer when formation of the ice billet commences; and determining that the timer has reached a predetermined formation time.

15. The method of claim 13, wherein determining that the ice billet formed within the ice mold has exceeded a predetermined thickness comprises:

measuring a thickness of the ice billet using a measurement device.

16. The method of claim 13, wherein the pump assembly comprises a flow regulating valve, the method further comprising:

adjusting a flow rate of the ice-building spray by regulating the flow regulating valve.

17. The method of claim 13, further comprising:

determining that formation of the ice billet is complete;

warming the ice mold; and operating the pump assembly to provide the ice-building spray at a third flow rate to remove at least a portion of the ice billet.

18. The ice making assembly of claim 1, wherein the shape or pattern of the ice-building spray is adjusted while maintaining a constant flow rate of the ice-building spray.

19. The method of claim 13, wherein the shape or pattern of the ice-building spray is adjusted while maintaining a constant flow rate of the ice-building spray.

* * * * *